US010314350B2

(12) United States Patent
Safford

(10) Patent No.: US 10,314,350 B2
(45) **Date of Patent: *Jun. 11, 2019**

(54) GLOVE WITH IMPACT GUARD

(71) Applicant: Mechanix Wear, Incorporated, Valencia, CA (US)

(72) Inventor: Kenneth Safford, Simi Valley, CA (US)

(73) Assignee: Mechanix Wear, Incorporated, Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/488,236

(22) Filed: Apr. 14, 2017

(65) Prior Publication Data

US 2018/0064186 A1 Mar. 8, 2018

Related U.S. Application Data

(63) Continuation of application No. 14/599,935, filed on Jan. 19, 2015, now Pat. No. 9,622,525, which is a continuation of application No. 13/918,700, filed on Jun. 14, 2013, now Pat. No. 8,935,812, which is a continuation of application No. 13/156,175, filed on Jun. 8, 2011, now Pat. No. 8,490,217.

(51) Int. Cl.
*A41D 19/015* (2006.01)

(52) U.S. Cl.
CPC ..... *A41D 19/01529* (2013.01); *A41D 19/015* (2013.01); *A41D 19/01523* (2013.01)

(58) Field of Classification Search
CPC ..... A41D 19/015; A41D 19/01523; A41D 19/01529; A41D 13/087; A41D 13/084; A41D 19/0006; A41D 19/01505; A41D 13/0156; A41D 13/081; A41D 19/01517; A41D 19/01547; A41D 19/01558; A41D 19/01564; A41D 19/0048; A41D 19/0058; A41D 13/082; A63B 71/141; A63B 71/143
USPC .... 2/161.6, 161.1, 161.2, 161.3, 161.8, 163, 2/159, 16, 20, 164, 21, 160, 161.5
See application file for complete search history.

(56) References Cited

U.S. PATENT DOCUMENTS 2,025,357 A 12/1935 Pagan
3,348,238 A 10/1967 Hydock
3,597,765 A 8/1971 Stanton
(Continued)

FOREIGN PATENT DOCUMENTS

KR 3004 16270 6/2006

OTHER PUBLICATIONS

Mechanix Glove Guide 2010, vol. 18; 13 pages.
(Continued)

*Primary Examiner* — Amy Vanatta
(74) *Attorney, Agent, or Firm* — Knobbe Martens Olson & Bear, LLP

(57) ABSTRACT

A glove has a top panel and a bottom panel that together form a main glove body. Fingers, including an index finger and other fingers, extend from the main glove body, each of the fingers having a top side and a bottom side corresponding with the top panel and bottom panels of the main glove body. A thumb extends from the main glove body. A region, at a juncture of the index finger and the main glove body on or adjacent the top panel and/or the thumb, has an insulating pad covering a portion of the region.

20 Claims, 2 Drawing Sheets

(56) References Cited

U.S. PATENT DOCUMENTS

| | | | | |
|---|---|---|---|---|
| 3,605,117 | A | 9/1971 | Latina | |
| 3,882,548 | A | 5/1975 | Shinagawa et al. | |
| 3,918,096 | A | 11/1975 | Shinagawa et al. | |
| 4,094,014 | A | 6/1978 | Schroeder | |
| D248,898 | S | 8/1978 | DeLeone et al. | |
| D268,968 | S | 5/1983 | Sami | |
| 4,484,359 | A | 11/1984 | Tirinen | |
| 4,570,269 | A | 2/1986 | Berlese | |
| 4,590,625 | A | 5/1986 | Keim | |
| D287,424 | S | 12/1986 | Berlese | |
| D288,981 | S | 3/1987 | Hale | |
| 4,768,234 | A | 9/1988 | Yamamoto | |
| 4,864,659 | A | 9/1989 | Morris | |
| 4,864,660 | A | 9/1989 | Sawyer | |
| 4,911,433 | A | 3/1990 | Walker et al. | |
| 4,930,162 | A | 6/1990 | Cote | |
| 5,067,175 | A | 11/1991 | Gold | |
| D328,369 | S | 7/1992 | Hong | |
| 5,423,089 | A | 6/1995 | Chun et al. | |
| 5,604,934 | A | 2/1997 | Willett | |
| 6,185,747 | B1 | 2/2001 | Hughes | |
| 6,405,380 | B1 | 6/2002 | Kuroda et al. | |
| 6,415,445 | B1 | 7/2002 | Nishijima et al. | |
| D461,620 | S | 8/2002 | Bevier | |
| 6,732,377 | B1 | 5/2004 | Wilkonson | |
| D490,966 | S | 6/2004 | Sasaki | |
| D516,277 | S | 3/2006 | Mattesky | |
| 7,275,268 | B2 | 10/2007 | Gait | |
| 7,337,474 | B1 | 3/2008 | Godson | |
| D589,678 | S | 4/2009 | Lawrence | |
| D604,027 | S | 11/2009 | Kleinert | |
| D608,978 | S | 2/2010 | Votel | |
| D621,553 | S | 8/2010 | Fitzgerald et al. | |
| D625,051 | S | 10/2010 | Fitzgerald et al. | |
| D653,427 | S | 2/2012 | Wong | |
| 8,490,217 | B2 | 7/2013 | Safford | |
| D696,467 | S | 12/2013 | Nelson | |
| 8,935,812 | B2 | 1/2015 | Safford | |
| D759,318 | S * | 6/2016 | Wyatt | D29/117.1 |
| D788,402 | S * | 6/2017 | Votel | D2/619 |
| D796,779 | S * | 9/2017 | Votel | D2/619 |
| 2003/0051285 | A1 | 3/2003 | Bower | |
| 2006/0195968 | A1 | 9/2006 | Powell | |
| 2007/0245453 | A1 | 10/2007 | Dolenak | |
| 2008/0263747 | A1 | 10/2008 | DeBlasis et al. | |
| 2009/0229035 | A1 | 9/2009 | Van Hale | |
| 2009/0307821 | A1 * | 12/2009 | Chang | A41D 19/01588 2/21 |
| 2010/0083420 | A1 | 4/2010 | Bouckaert | |
| 2010/0192279 | A1 | 8/2010 | Hunsicker | |
| 2011/0088139 | A1 * | 4/2011 | Travell | A41D 19/01588 2/161.1 |
| 2011/0107498 | A1 * | 5/2011 | Chang | A41D 19/01588 2/163 |

OTHER PUBLICATIONS

Mechanix Wear "M-Pact Glove," as shown in NASCAR Illustrated magazine as of Apr. 1, 2012. Downloaded from the Internet on May 4, 2018.

* cited by examiner

GLOVE WITH IMPACT GUARD

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This invention relates generally to gloves, and more particularly to a protective glove that is particularly adapted for use in tight spaces.

Description of the Related Art

Protective gloves are known in the art, including gloves that include various forms of protective panels and ridges for protecting the back of the user's hand. For example, Shinagawa, U.S. Pat. No. 3,882,548, teaches a glove with protective ridges that extend down the backs of all of the fingers to a traverse region that protects the knuckles of the user. Importantly, when a glove includes such protective ridges, the extend down all of the fingers, including the index finger, and the knuckle protecting traverse region extends all the way across the back of the glove to the index finger.

The disadvantage of such a glove construction is that the protective ridges are thick enough to impede work in confined spaces. The protective ridge on the index finger, and in a region around the index finger and the thumb, especially impedes work in a confined space. The above-described reference is hereby incorporated by reference in full.

The prior art teaches protective gloves that include protective ridges on all fingers, or on none. However, the prior art does not teach a glove that includes protective ridges on fingers excluding the index finger, but leave the index finger unencumbered. The prior art also does not teach the inclusion of an insulating pad in the region, to protect the user from burns in the critical region. The present invention fulfills these needs and provides further related advantages as described in the following summary.

SUMMARY OF THE INVENTION

The present invention teaches certain benefits in construction and use which give rise to the objectives described below.

The present invention provides a glove for protecting a hand. The glove comprises a top panel for covering a back of the hand; a bottom panel for covering a palm of the hand, the top and bottom panels being connected to form a main glove body; fingers, including an index finger and other fingers, extending from the main glove body, each of the fingers having a top side and a bottom side corresponding with the top panel and bottom panels of the main glove body; and a thumb extending from the main glove body. A region, at a juncture of the index finger and the main glove body on or adjacent the top panel and/or the thumb, has an insulating pad covering a portion of the region.

A primary objective of the present invention is to provide a glove having advantages not taught by the prior art.

Another objective is to provide a glove that includes an insulating pad over a region of the glove that is particularly susceptible to injury.

A further objective is to provide a glove that includes an index finger that does not include protrusions, so that the index finger may be inserted into tight places without hindrance from the glove.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENT

The above-described drawing figures illustrate the invention, a glove for protecting a hand of a user. The glove particularly well adapted for working in tight places, and includes a specially configured index finger having an insulating pad operatively positioned to protect the user's hand without interfering with the use of the index finger within the tight place.

Figure 1:
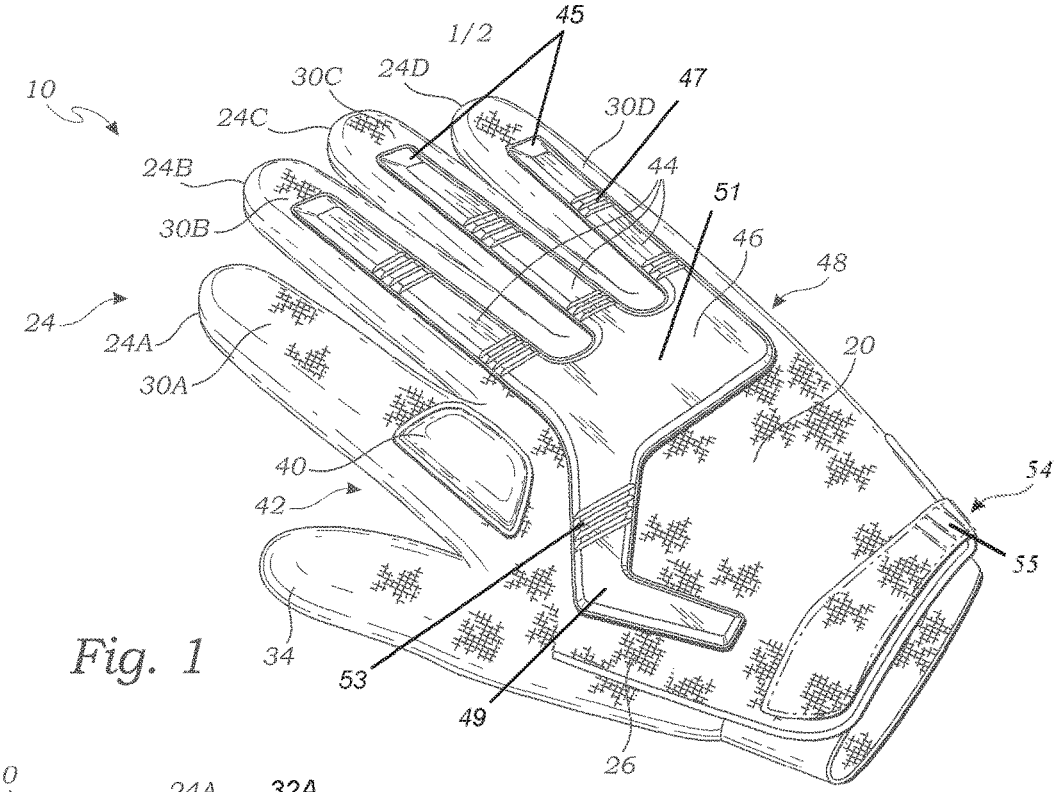
FIG. 1 is a top perspective view of a glove according to one embodiment of the present invention.
Figure 2:
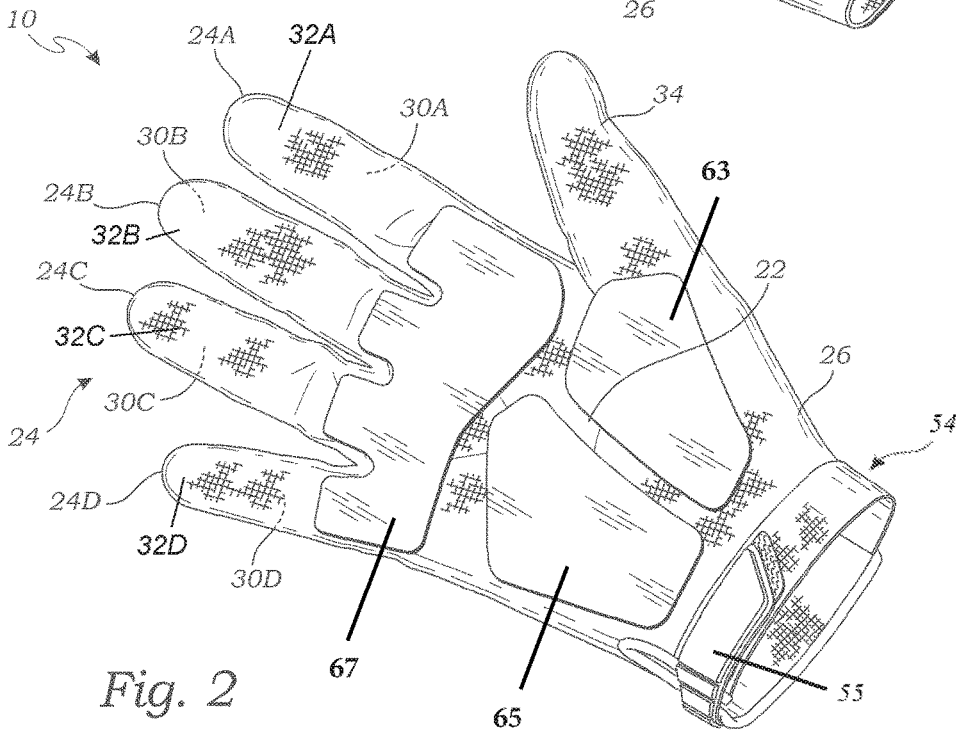
FIG. 2 is a bottom perspective view thereof.
Figure 3:
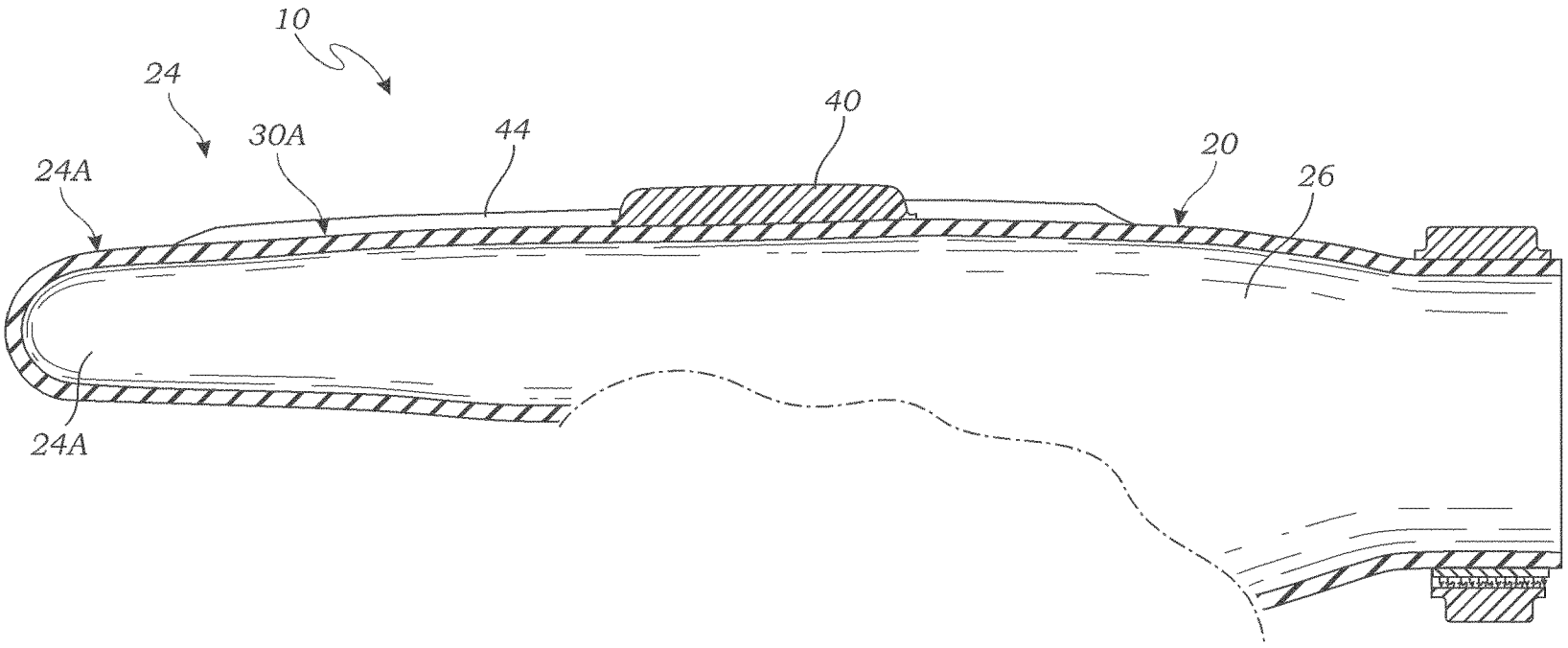
FIG. 3 is a side sectional view of an index finger of the glove, illustrating an insulating pad of the glove.

FIG. 1 is a top perspective view of the glove 10 according to one embodiment of the present invention. FIG. 2 is a bottom perspective view thereof. As shown in FIGS. 1-2, the glove 10 includes a top panel 20 for covering a back of the hand, an opposed bottom panel 22, and fingers 24. FIG. 3 is a side sectional view of an index finger 24A of the glove 10, illustrating an insulating pad 40 of the glove 10.

As illustrated in FIGS. 1-3, the top panel 20 is shaped and constructed for covering a back of the hand. The bottom panel 22 is shaped and constructed for covering a palm of the hand. The top and bottom panels 22 are connected (e.g., sewn) to form a main glove body 26. The fingers 24, including an index finger 24A and other fingers 24B, 24C, and 24D, extend from the main glove body 26 and are shaped to each receive a finger of the hand. Each of the fingers 24 includes a top side 30A, 30B, 30C, and 30D and a bottom side 32A, 32B, 32C, and 32D corresponding with the top panel 20 and bottom panels 22 of the main glove body 26. A thumb 34 extends from the main glove body 26 shaped to accommodate the user's thumb 34. As illustrated in FIGS. 1-2, a closure member 55 is positioned on a bottom surface in a cuff region 54 of the glove 10. The closure member 55 is positioned between two of the three panels connected to the bottom panel and an edge of the cuff region 54. The general construction of the glove 10 is similar to prior art gloves 10, and is therefore not discussed in greater detail. The bottom panel 22 can comprise one or more panels that can extend along a portion of the bottom panel 22 of glove 10. For example, as shown in FIG. 2, panels 63, 65, and/or 67 can connect to bottom panel 22. Panel 67 can be positioned between one or more of fingers 24 (e.g., fingers 24A, 24B, 24C, 24D) and panel 63 and/or panel 65. Panel 67 can comprise extensions that extend along a portion of one or more of fingers 24. For example, panel 67 can comprise extensions that extend over junctures between one or more of fingers 24*a*, 24*b*, 24*c*, 24*d* and the main glove body 26 (see FIG. 2).

Critical to the invention is the insulating pad 40 positioned within a region 42 at a juncture of the index finger 24A and the main glove body 26 on or adjacent the top panel 20 and/or the thumb 34. In one embodiment, the insulating pad 40 is a rubberized grip insert that is sewn, bonded, or otherwise attached to the region 42 of the glove 10. The insulating pad 40 is positioned to protect the user's hand from damage, and in particular from burns, when the user is inserting his or her hand into a tight location that might have elements that are hot (e.g., inside an engine, etc.). In one embodiment, the insulating pad 40 does not extend beyond the region 42, but is only positioned within the region 42 for protecting the user from injuries particular to this region 42. In the preferred embodiment, the insulating pad 40 is positioned over the proximal phalange of the user's index finger, and does not extend to the medial phalange or the metacarpal of the user's hand.

To further protect the user's hand, the glove 10 may further include thermoplastic or molded rubber protective ridges 44 extending upwardly from the top panel 20 of each of the other fingers 24B, 24C, and 24D. However, it is preferred that the index finger 24A not include such a protective ridge 44. The protective ridges 44 can have a width that is smaller than a width of a top side of the associated finger. The protective ridges 44 can have a length extending at least two-thirds or at least three-fourths of the length of the associated finger. The protective ridge 44 has a distal end comprising a tapering surface 45 tapering from a top surface of the protective ridge 44 toward a top side of a fingertip region of a finger such that the distal end has a smaller thickness than a more proximal portion. The protective ridges 44 can have one or more flex points 47, which can enhance the flexibility of the protective ridges 44 when the glove 10 is in use. The one or more flex points 47 can comprise one or more serrated portions defined by one or more cuts. For example, the one or more flex points 47 can comprise serrated portions defined by at least one, at least two, or at least three cuts.

In the embodiment of FIG. 1, the glove 10 further includes a knuckle protector 46 extending across a knuckle region 48 of the top panel 20. The knuckle panel may be integrally formed with the protective ridges 44 of the other fingers 24B, 24C, and 24D, but preferably does not extend into the region 42 of the insulating pad 40. The knuckle protector 46 comprises an extension away from the fingers, the extension comprising a tail portion 49 extending in a direction that is substantially orthogonal to a direction of the thumb and a main region 51 extending from the tail portion in a direction that is generally parallel to at least one of the fingers. The knuckle protector 46 can include one or more flex points 53, which can enhance the flexibility of the knuckle protector 46 when the glove 10 is in use. For example, the tail portion 49 can include one or more flex points 53 along a portion thereof. The one or more flex points 53 can comprise one or more serrated portions defined by one or more cuts. For example, the one or more flex points 47 can comprise at least one, at least two, at least three, or at least four cuts.

In this manner, the index finger 24A of the glove 10 does not include protrusions that extend outwardly from the glove 10 in a manner that might restrict use of the glove 10 in tight spaces; and yet the insulating pad 40, carefully positioned in the region 42 specified, operates to protect the user from injury and burns in this region 42 that is particularly susceptible to injury when being used in this manner.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A glove for protecting a hand, the glove comprising:

a top surface and a bottom surface, the top surface comprising a top panel that is adapted to cover a back of the hand, the bottom surface comprising a bottom panel that is connected to the top panel, the bottom panel being adapted to cover a palm of the hand, the top panel and the bottom panel being connected to form a main glove body;

a plurality of fingers extending from the main glove body, the plurality of fingers including an index finger, a middle finger, a ring finger, and a little finger, each of the fingers having a top side and a bottom side corresponding with the top surface and the bottom surface, a thumb also extending from the main glove body, the index finger having a proximal base portion that adjoins the main glove body and a distal end portion at an opposing end of the index finger;

an insulating pad being positioned along the top side of the index finger, the insulating pad comprising a rubberized grip member, the rubberized grip being sewn into position between the distal end portion of the index finger and the proximal base portion, the rubberized grip being sized and configured to be positioned over the proximal phalange of the index finger of a user; and a protective ridge overlying at least a majority of the top side of each of the middle finger, the ring finger, and the little finger, the protective ridge of each of the middle finger, the ring finger, and the little finger extending to a knuckle protector, the knuckle protector extending laterally across the top surface of the main glove body and being integrally formed with the protective ridge of each of the middle finger, the ring finger, and the little finger, wherein the knuckle protector is spaced apart from the insulating pad.

2. The glove of claim 1, wherein each of the protective ridges includes two serrated regions along its length.

3. The glove of claim 2, wherein each of the serrated regions comprises at least three cuts across the protective ridge that defines the serrated region.

4. The glove of claim 3, wherein each of the protective ridges terminates in a fingertip region with a tapering surface.

5. The glove of claim 3, wherein the knuckle protector comprises a serrated portion positioned proximate to the index finger and the thumb.

6. The glove of claim 5, wherein the serrated portion of the knuckle protector comprises four cuts that define the serrated portion.

7. The glove of claim 5, wherein the knuckle protector has a main region and a tail that extends away from the main region and the serrated portion is disposed along the tail.

8. The glove of claim 7, wherein the tail has a first portion and a second portion that are angled relative to each other, the first portion of the tail being positioned between the main region of the knuckle protector and the second portion of the tail.

9. The glove of claim 8, wherein the serrated portion of the knuckle protector is positioned along the first portion of the tail.

10. The glove of claim 8, wherein the bottom panel comprises three panels connected to the bottom panel.

11. The glove of claim 10, wherein one of the three panels is positioned between the plurality of fingers and two of the three panels.

12. The glove of claim 11, wherein the one of the three panels comprises extensions that extend along at least a portion of each of the plurality of fingers.

13. The glove of claim 12, wherein the extensions extend over junctures between the plurality of fingers and the glove main body.

14. The glove of claim 12, wherein a closure member is positioned on a bottom surface in a cuff region of the glove.

15. The glove of claim 14, wherein the closure member is positioned between the two of the three panels and an edge of the cuff region.

16. A glove for protecting a hand, the glove comprising:

a main body comprising a top panel that is adapted to cover a back of the hand in use and a bottom panel that is connected to the top panel, the bottom panel being adapted to cover a palm of the hand in use, the top panel and the bottom panel extending along an index finger, a middle finger, a ring finger, and a little finger, and wherein at least two additional panels are connected to the bottom panel;

an opening into the glove defined along a top panel edge and a bottom panel edge, wherein the main body of the glove separates the index finger, the middle finger, the ring finger, and the little finger from the opening;

an insulating pad being positioned along the top panel of the main body, the insulating pad being at least partially secured to the main body, the insulating pad being configured to overlie a region of the glove between a distal tip of the index finger and the opening; and a continuous knuckle protector extending laterally across a knuckle region on the top panel of the main glove body, the knuckle protector being at least partially secured to the main body, the knuckle protector being positioned between the opening and distal tips of each of the middle finger, the ring finger, and the little finger so as to overlie the knuckle region without contacting the insulating pad, wherein the knuckle protector comprises at least one serrated portion.

17. The glove of claim 16, further comprising a protective ridge overlying at least a majority but less than a full length of the top side of each of the middle finger, the ring finger, and the little finger, the protective ridge of each of the middle finger, the ring finger, and the little finger extending to the knuckle protector, the knuckle protector being integrally formed with the protective ridge of each of the middle finger, the ring finger, and the little finger.

18. The glove of claim 16, wherein the knuckle protector is formed of a thermoplastic or molded rubber.

19. The glove of claim 16, wherein the knuckle protector has a main region and a tail that extends away from the main region, and wherein the at least one serrated portion is positioned between the tail and the main region.

20. The glove of claim 16, wherein the at least one serrated portion defines a flex point to enhance the flexibility of the knuckle protector when the glove is in use.

* * * * *